US008008240B2

(12) United States Patent
Morrison et al.

(10) Patent No.: US 8,008,240 B2
(45) Date of Patent: Aug. 30, 2011

(54) PROCESS FOR TREATING A HARD SURFACE USING AN EO/PO TRISILOXANE

(75) Inventors: Christopher Andrew Morrison, Genval (BE); Robby Renilde François Keuleers, Lippelo (BE); Thomas Delaere, Jette (BE); Mercedes Labiano Ros, Saragossa (ES)

(73) Assignee: The Procter & Gamble Company, Cincinnati, OH (US)

( * ) Notice: Subject to any disclaimer, the term of this patent is extended or adjusted under 35 U.S.C. 154(b) by 141 days.

(21) Appl. No.: 12/211,290

(22) Filed: Sep. 16, 2008

(65) Prior Publication Data

US 2009/0084402 A1 Apr. 2, 2009

(30) Foreign Application Priority Data

Sep. 17, 2007 (EP) ..... 07116572

(51) Int. Cl.
*C11D 1/82* (2006.01)
*C11D 1/04* (2006.01)

(52) U.S. Cl. ..... 510/180; 510/181; 510/189; 510/199; 510/238; 510/243; 510/421; 510/422; 510/437; 510/466; 510/491

(58) Field of Classification Search ..... 510/180, 510/181, 189, 199, 238, 243, 421, 422, 437, 510/466, 491
See application file for complete search history.

(56) References Cited

U.S. PATENT DOCUMENTS

| | | | | |
|---|---|---|---|---|
| 3,933,407 | A * | 1/1976 | Tu et al. | 359/507 |
| 4,167,488 | A | 9/1979 | Murtaugh | |
| 4,374,745 | A | 2/1983 | Sibley et al. | |
| 4,960,533 | A | 10/1990 | Wisniewski et al. | |
| 5,439,609 | A | 8/1995 | Pasek | |
| 5,699,189 | A | 12/1997 | Murphy | |
| 5,741,760 | A | 4/1998 | Mondin et al. | |
| 6,051,730 | A * | 4/2000 | Pallas et al. | 556/419 |
| 6,090,765 | A | 7/2000 | Black et al. | |
| 6,191,090 | B1 | 2/2001 | Mondin et al. | |
| 6,239,166 | B1 | 5/2001 | Black | |
| 6,242,402 | B1 * | 6/2001 | Robbins et al. | 510/238 |
| 6,506,261 | B1 | 1/2003 | Man | |
| 2002/0115581 | A1 | 8/2002 | DuVal et al. | |
| 2002/0193278 | A1 * | 12/2002 | Cermenati et al. | 510/465 |
| 2003/0180466 | A1 * | 9/2003 | Rohrbaugh et al. | 427/372.2 |
| 2004/0097389 | A1 | 5/2004 | Yeo et al. | |
| 2005/0015888 | A1 * | 1/2005 | Altmann et al. | 8/115.51 |
| 2005/0148544 | A1 * | 7/2005 | Uchiyama et al. | 514/58 |
| 2005/0250668 | A1 | 11/2005 | Serobian et al. | |
| 2006/0030497 | A1 * | 2/2006 | Sperling | 508/208 |
| 2006/0247150 | A1 * | 11/2006 | Molinaro et al. | 510/499 |
| 2006/0281663 | A1 | 12/2006 | Asmus | |
| 2007/0275867 | A1 * | 11/2007 | Serobian | 510/466 |
| 2008/0145552 | A1 * | 6/2008 | Berrettini et al. | 427/444 |
| 2008/0171683 | A1 * | 7/2008 | Johnson et al. | 510/275 |
| 2009/0062175 | A1 | 3/2009 | Cermenati et al. | |
| 2009/0075858 | A1 | 3/2009 | Tomarchio et al. | |

FOREIGN PATENT DOCUMENTS

| | | | |
|---|---|---|---|
| EP | 1 245 666 | A1 | 10/2002 |
| EP | 1 245 667 | A1 | 10/2002 |
| EP | 1 473 355 | A1 | 11/2004 |
| WO | WO 96/00274 | A | 1/1996 |
| WO | WO 02/12455 | A1 | 2/2002 |

OTHER PUBLICATIONS

PCT International Search Report, 4 Pages, Mail Jan. 29, 2009.

* cited by examiner

*Primary Examiner* — Charles I Boyer
(74) *Attorney, Agent, or Firm* — John T. Dipre; Leonard W. Lewis; Steven W. Miller

(57) ABSTRACT

The present invention relates to a process of treating a hard surface with a composition comprising polyalkoxylate trisiloxane. More specifically, it relates to a process of treating an horizontal hard surface, wherein a composition comprising polyalkoxylate trisiloxane is applied onto said hard surface.

11 Claims, 2 Drawing Sheets

Test on Ceramic

Test on PVC

PROCESS FOR TREATING A HARD SURFACE USING AN EO/PO TRISILOXANE

FIELD OF THE INVENTION

The present invention relates to a process of treating a hard surface with a composition comprising polyalkoxylate trisiloxane.

BACKGROUND OF THE INVENTION

A great variety of treating compositions have been described in the art. Even though, the currently known compositions provide a good performance with regard to treating performance, manufacturers of hard surface cleaning compositions are continuously searching for new components that will improve the effectiveness of the compositions. Indeed, it has been found by consumer research that the performance of the compositions can be further improved; more especially, when these compositions are used to treat large and wide hard surface areas.

Thus, there is a constant need for compositions that are easy to apply in order to reduce the amount of effort required from the user and to avoid or minimise the contact of the user with the cleaning composition, especially when used for treating large hard surface areas.

It has now been found that this objective can be met by a process of cleaning a hard surface with a liquid composition as described herein.

It is therefore an objective of the present invention to provide a process for treating wide and large hard surface areas, which is convenient for the user and wherein said process provides excellent overall cleaning performance on the surfaces treated therewith and renders said surfaces less prone to resoiling, limescale build-up and/or mineral-encrustation build-up.

An advantage of the present invention is that the process describe herein allows the consumer to reduce the amount of product used to treat surface. Indeed, it has surprisingly be found that the composition according to the present invention have a specific spreading effect when used on hard surface. As a matter of fact, the composition, used in the process herein defined, creates a spreading effect when applied to hard surface, which allow the composition to act more effectively on a wide area of the hard surface.

Meaning thus that, due to this spreading effect, the process according to the present invention will allow the user to use less amount of composition for cleaning a given surface by comparison with traditional composition, whilst still having excellent cleaning performance. Even more, another advantage of the process of the present invention is that it provides fast drying performance on the surface treated herein.

Advantageously, the process as described herein may be used to clean surfaces made of a variety of materials like glazed and non-glazed ceramic tiles, enamel, stainless steel, Inox®, Formica®, vinyl, no-wax vinyl, linoleum, melamine, glass, plastics and plastified wood.

BACKGROUND ART

The following documents are representative of the prior art available on hard surface cleaning compositions containing siloxane copolymers.

WO 96/12005 relates to glass cleaning composition containing a silicone glycol. WO 02/12455 discloses plastics compatible detergent composition containing polysiloxanes. EP 1 245 666 relates to composition, suitable for cleaning a surface, comprising a silicone polymer, wherein said composition is capable of increasing the hydrophobicity of the surface treated herein. EP 1 245 667 relates to a process for cleaning hard surface selected from toilet bowls and urinals, with a liquid composition comprising a silicone glycol. U.S. Pat. No. 5,439,609 relates to an aqueous cleaning composition suited for hard surface, particularly tile surfaces containing from 0.1 weight % to about 5 weight % of a silicone block polymer having a specific formula

SUMMARY OF THE INVENTION

The present invention encompasses a process of treating a horizontal hard surface comprising the step of applying a liquid composition onto said hard surface using a dispersing container, wherein said composition comprises a polyalkoxylate trisiloxane having the formula (I):

$$(R^1)_3SiO—R^1SiR^2O—Si(R^1)_3 \quad (I)$$

wherein each $R^1$ independently represents a $C_{1-6}$ straight or branched, substituted or unsubstituted, saturated or unsaturated alkyl; wherein $R^2$ is $—CH_2—(CH_2)_p—O—(C_2H_4O)_a(C_4H_6O)_b(C_6H_8O)_c—R^3$; wherein a, b, c and p are numbers that range from about 0 to about 30; wherein $a+b+c \geqq 1$; and wherein $R^3$ represents hydrogen or a $C_{1-6}$ straight or branched, substituted or unsubstituted, saturated or unsaturated alkyl.

DETAILED DESCRIPTION OF THE INVENTION

Figure 1:
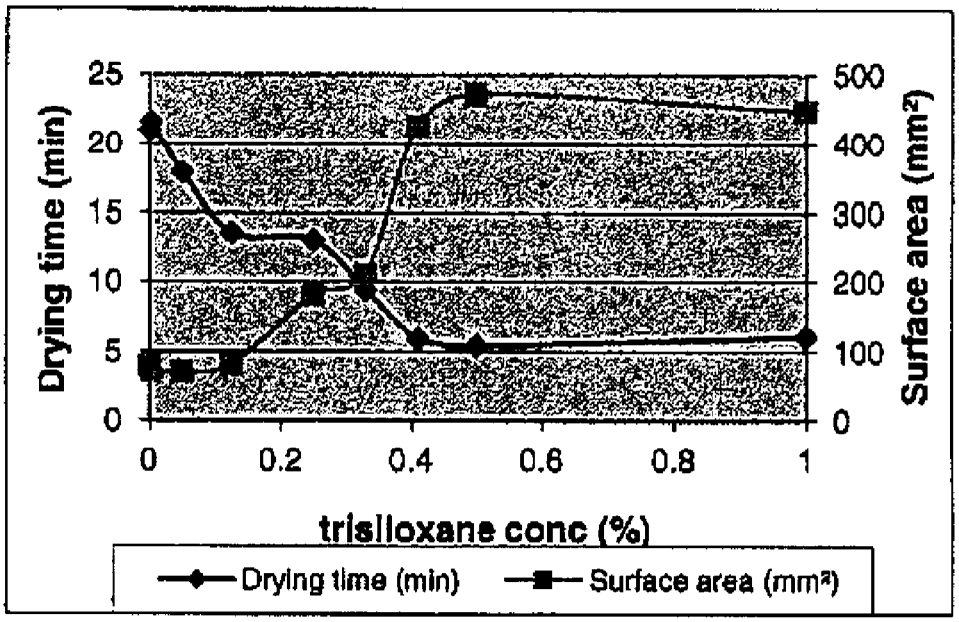
FIG. 1 illustrates the drying and spreading results obtained on Ceramic with compositions containing trisiloxane.

The Process of Treating a Hard Surface

The present invention encompasses a process of treating a hard surface with a liquid composition as described herein. In particular, the present invention encompasses a process of treating an horizontal hard surface with a liquid composition comprising polyalkoxylate trisiloxane having the formula (I):

$$(R^1)_3SiO—R^1SiR^2O—Si(R^1)_3 \quad (I)$$

wherein each $R^1$ independently represents a $C_{1-6}$ straight or branched, substituted or unsubstituted, saturated or unsaturated alkyl; wherein $R^2$ is $—CH_2—(CH_2)_p—O—(C_2H_4O)_a(C_4H_6O)_b(C_6H_8O)_c—R^3$; wherein a, b, c and p are numbers that range from about 0 to about 30; wherein $a+b+c \geqq 1$; and wherein $R^3$ represents hydrogen or a $C_{1-6}$ straight or branched, substituted or unsubstituted, saturated or unsaturated alkyl. Such polyalkoxylate trisiloxane have a molecular weight ($M_n$) of max 3 000.

By "treating" it is meant herein, cleaning, as the composition according to the present invention provides excellent first-time and next-time cleaning performance on various stains.

By "hard surface", it is meant herein any kind of surface typically found in houses like kitchens, bathrooms, e.g., floors, walls, tiles, windows, cupboards, sinks, showers, shower plastified curtains, wash basins, WCs, dishes, fixtures and fittings and the like made of different materials like ceramic, vinyl, no-wax vinyl, linoleum, melamine, glass, Inox®, Formica®, any plastics, plastified wood, metal or any painted or varnished or sealed surface and the like.

According to the present invention, the hard surfaces to be cleaned in the process herein are horizontal hard surfaces.

In a preferred embodiment according to the present invention, the hard surface to be cleaned in the process herein is selected from the group consisting of ceramic, glass, enamel, stainless steel and chromed surfaces. Preferably, the hard surface to be cleaned in the process herein is ceramic surfaces.

An essential feature according to the present invention, is that the hard surface to be cleaned are horizontal hard surfaces, such as for example floors and the like.

In a preferred embodiment of the process of the present invention, the hard surfaces treated herein are large and wide hard surface areas.

The compositions of the present invention may be contacted to the hard-surface to be treated in its neat form or in its diluted form. Preferably, the composition is applied in its neat form.

By "in its neat form", it is to be understood that the liquid compositions are applied directly onto the surface to be treated without undergoing any dilution, i.e., the liquid compositions herein are applied onto the hard-surface as described herein.

By "diluted form", it is meant herein that said composition is diluted by the user with an appropriate solvent, typically with water. The composition is diluted prior use to a typical dilution level of 10 to 400 times its weight of water, preferably from 10 to 200 and more preferably from 10 to 100. Dilution may occur immediately prior to the application of the composition herein onto the hard surface to be cleaned, e.g., in an appropriate receptacle such as a bucket, wherein an effective amount of liquid composition herein is mixed with water.

In a more preferred embodiment the composition is used in a diluted form.

In the process herein, said composition is applied onto said surface by dispersing and sprinkling said composition onto said surface using an appropriate packaging.

In a more preferred embodiment of the present invention, the composition is sprinkled on the hard surface to be treated. More preferably, said liquid composition is sprinkled in its neat form onto said hard surface.

In another preferred embodiment of the present invention said process of cleaning a hard surface includes the steps of applying, preferably sprinkling, said liquid composition onto said hard surface, leaving said liquid composition to act onto said surface for a period of time to allow said composition to act, preferably without applying mechanical action, and optionally removing said liquid composition, preferably removing said liquid composition by rinsing said hard surface with water and/or wiping said hard surface with an appropriate instrument, e.g., a sponge, a paper or cloth towel and the like.

In a more preferred embodiment of the present invention, the process includes the steps of sprinkling, said liquid composition onto said hard surface, leaving said liquid composition to act onto said surface, removing said liquid composition, preferably without rinsing said hard surface with water, but with the action of wiping said hard surface with an appropriate instrument, e.g., a sponge, a paper or cloth towel and the like.

In another process of cleaning a hard surface according to the present invention, the composition is applied onto said surface in a pre-diluted form, without rinsing the hard-surface after application, in order to obtain good soil/stain removal performance.

By "rinsing", it is mean herein contacting the hard surface cleaned with the process according to the present invention with substantial quantities of appropriate solvent, typically water, directly after the step of applying the liquid composition herein onto said hard surface. By "substantial quantities", it is meant herein between 0.01 lt. and 1 lt. of water per $m^2$ of hard surface, more preferably between 0.1 lt. and 1 lt. of water per $m^2$ of hard surface.

The hard surfaces to be treated may be soiled with a variety of soils, e.g., greasy soils (e.g., greasy soap scum, body grease, kitchen grease or burnt/sticky food residues typically found in a kitchen and the like), particulate greasy soils or so called "limescale-containing stains". By "limescale-containing stains" it is meant herein any pure limescale stains, i.e., any stains composed essentially of mineral deposits, as well as limescale-containing stains, i.e., stains which contain not only mineral deposits like calcium and/or magnesium carbonate but also soap scum (e.g., calcium stearate) and other grease (e.g. body grease).

Liquid Composition

The composition used in the process according to the present invention is formulated as a liquid composition.

Preferred compositions herein have a viscosity of 1 cps or greater, more preferably of from 1 to 20000 cps, and still more preferably of from 1 to 500 cps at 20° C. when measured with a $CSL^2$ 100® Rheometer at 20° C. with a 4 cm spindle (linear increment from 10 to 100 dyne/$cm^2$ in 2 minutes).

A preferred composition herein is an aqueous composition and therefore, preferably comprises water more preferably in an amount of from 50% to 99%, even more preferably of from 75% to 97% and most preferably 80% to 97% by weight of the total composition.

The pH of the liquid composition according to the present invention may typically be from 0 to 14.

In a preferred embodiment, the pH of the liquid composition according to the present invention is from 0 to 4 or from 9 to 14, preferably from 0 to 3 or from 10 to 14.

In a more preferred embodiment, the pH range is from 9 to 14, preferably from 9.1 to 14, more preferably from 9.1 to 13, even more preferably from 9.1 to 12. In a another more preferred embodiment, the pH range is from 10 to 14, preferably from 10.1 to 14, more preferably from 10.1 to 13, even more preferably from 10.1 to 12.

In a yet another preferred embodiment, pH range is from 0 to 4, preferably from 0.1 to 4, more preferably from 0.1 to 3, more preferably from 0.1 to 2.

A suitable acid for use herein is an organic and/or an inorganic acid. A preferred organic acid for use herein has a pKa of less than 6. A suitable organic acid is selected from the group consisting of citric acid, lactic acid, glycolic acid, succinic acid, glutaric acid and adipic acid and a mixture thereof. A mixture of said acids may be commercially available from BASF under the trade name Sokalan® DCS. A suitable inorganic acid is selected from the group consisting hydrochloric acid, sulphuric acid, phosphoric acid and a mixture thereof.

A typical level of such an acid, when present, is of from 0.01% to 5.0%, preferably from 0.04% to 3.0% and more preferably from 0.05% to 1.5% by weight of the total composition.

A suitable base to be used herein is an organic and/or inorganic base. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate, $K_2CO_3$, $Na_2CO_3$ and alkanolamines (as e.g. monoethanolamine).

Typical levels of such bases, when present, are of from 0.01% to 5.0%, preferably from 0.05% to 3.0% and more preferably from 0.1% to 0.6% by weight of the total composition.

Polyalkoxylate Trisiloxane

An essential feature of the present invention is that the composition comprises a polyalkoxylate trisiloxane.

The polyalkoxylate trisiloxane according to the present invention is present in the liquid composition in an amount of from 0.001% to 10%, preferably from 0.01% to 1%, more preferably 0.1% and 0.5% by weight of the total composition.

The polyalkoxylate trisiloxane is found to be especially useful in the present invention to provide the composition with spreading property when composition is applied to horizontal surfaces. Without intending to be bound by theory, it is believed that the compact trisiloxane hydrophobic moiety in the polyalkoxylate trisiloxane allows a better surfactant packing at the air-water-substrate interface and induces a spreading behavior of the liquid composition containing such polyalkoxylate trisiloxane on the composition. By "spreading effect" it is meant herein that the composition containing such polyalkoxylate trisiloxane will be dispersed and spread all over the surface to be treated.

Polyalkoxylate trisiloxane, having the following general formula (I), is an essential ingredient of the liquid composition:

$$(R^1)_3SiO—R^1SiR^2O—Si(R^1)_3 \quad (I)$$

wherein each $R^1$ independently represents a $C_{1-6}$ straight or branched, substituted or unsubstituted, saturated or unsaturated alkyl; wherein $R^2$ is $—CH_2—(CH_2)_p—O—(C_2H_4O)_a(C_4H_6O)_b(C_6H_8O)_c—R^3$; wherein a, b, c and p are numbers that range from about 0 to about 30, preferably from 0 to 10; wherein $a+b+c \geqq 1$; and wherein $R^3$ represents hydrogen or a $C_{1-6}$ straight or branched, substituted or unsubstituted, saturated or unsaturated alkyl. Such polyalkoxylate trisiloxane have a molecular weight of max 3000.

In a preferred embodiment, a+b is $\geqq 1$, more preferably, b is at least $\geqq 1$.

In a more preferred embodiment, $R^2$ is $—CH_2—(CH_2)_p—O—(C_2H_4O)_a(C_4H_6O)_b—R^3$; wherein a, b and p are numbers that range from about 0 to about 30, preferably from 0 to 10; wherein $a+b \geqq 1$; wherein b is at least $\geqq 1$ and wherein $R^3$ represents hydrogen or a $C_{1-6}$ straight or branched, substituted or unsubstituted, saturated or unsaturated alkyl.

In an other more preferred embodiment the polyalkoxylate trisiloxane have a molecular weight ($M_n$) of maximum 3 000, more preferably a molecular weight ($M_n$) of maximum 1 000. In a more preferred embodiment, the molecular weight of the polyalkoxylate trisiloxane according to the present invention is from 300 to 1000.

In a preferred embodiment, the trisiloxane according to the present invention have the formula (II):

$$(CH_3)_3Si—O—(CH_3)Si(R^4)O—Si(CH_3)_3 \quad (II)$$

wherein $R^4 = —(CH_2)_x—O—(CH_2CH_2O)_y(CHCH_3CH_2O)_zR^5$ wherein x is 1 to 10, preferably 2 to 6, wherein y is 1 to 16, preferably 3 to 9, and wherein z is 1 to 12, preferably 2 to 5; $R^5$ is H or $CH_3$.

In a preferred embodiment, the trisiloxane according to the present invention have the formula (II) wherein x=3, y=4 and z=2; and $R^5$ is H.

Thus, in a even more preferred embodiment, the trisiloxane according to the present invention have the formula:

$$(CH_3)_3Si—O(CH_3)Si[(CH_2)_3—O—(CH_2CH_2O)_4(CH_2CH_2CH_2O)_2H]—O—Si(CH_3)_3$$

Such preferred polyalkoxylate trisiloxanes are commercially available under the tradename of SILWET® available from Momentive. Specially preferred polyalkoxylate trisiloxane for use herein are Silwet® L77, Silwet® L7280, Silwet® L7607 and Silwet® L7608. Silwet® L7280 is especially preferred for its environmental profile. Other suitable polyalkoxylated trisiloxane are those supplied by Degusa (sold under the numbers 5840, 5847 and 5878), Dow Corning (sold under the numbers DC 5211 and DC5212) and Wacker (sold under the number LO66).

These polyalkoxylate trisiloxane are also known by the name of siloxane polyoxyalkylene copolymers, siloxane polyethers, polyalkylene oxide silicone copolymers, silicone poly(oxyalkylene) copolymers, silicone glycol copolymers (or surfactants).

Packaging Form of the Compositions

An essential feature of the present invention is that the containers are dispersing containers, meaning thus that this container are able to disperse and to sprinkle the composition of the presenting invention over wide and large surfaces.

According to the process of the present invention, the dispersing containers will allow the composition to cover large surfaces of the horizontal surface treated therein. The container used in the process herein can also be defines as the so-called "downward-spray" or "shower" container. Therefore, as "dispersing containers" it is meant herein a container that is able to sprinkle the composition on wide surface, under a "fan-shaped" spray, using a fan-angled nozzle. The dispersing container will thus be able to dispense the liquid composition of the present invention spread over the horizontal surface in a balance and homogenous way over all the surfaces.

This dispersing containers will also have the ability of optimizing the amount of composition used upon the horizontal hard surface to be treated, meaning thus that only a small amount of composition will be used to treat large and wide surface area.

The dispersing containers used in the process of the present invention comprise a conventional reservoir, i.e. called container, and a specific nozzle in fluid communication with the so-called reservoir.

The reservoirs herein can be any variety of containers including conventional bottles, well known by the skilled person. According to the present invention, the container has the form of conventional bottle or spray.

An important feature of the dispersing container of the present invention is the nozzle in fluid communication with the reservoir, these nozzles having, at least, one orifice which will be able to sprinkle the composition to the hard surface. Preferably the nozzle of the container comprise a multi-jet spray-head having a plurality of orifices adapted to discharge the liquid composition under a "fan-shaped".

By a "fan-shaped", it is meant herein that the stream of the product will be widely dispersed and have the form of a fan in view of having a better coverage of the treated hard surface by the liquid composition. Meaning thus that the spray, made when using the dispersing container according to the present invention, when coming out from the outlet, will have an angle comprise between 40° and 180°, more preferably between 45 and 100°. In other word, the spray, when coming out from the outlet of the container, will cover surface defined by an angle comprised between 40° and 180°, more preferably between 45 and 100°.

The spray, coming out of the dispersing container, is obtained by gravitational forces in such a way that it generated a "fan-shaped" spray which will deposit in a uniform way onto the surface to be treated. In order to cover relatively rapidly the large and wide surface, it is also important that the dispersing container can deliver enough, and well adapted, volume of the liquid at a same relatively high flow rate so that the dispersing container generates a uniform spray pattern onto the horizontal surface treated.

Optional Composition Ingredients

The liquid compositions according to the present invention may comprise a variety of optional ingredients depending on the technical benefit aimed for and the surface treated.

Suitable optional ingredients for use herein include surfactants, builders, chelants, polymers, buffers, bactericides, preservatives, hydrotropes, stabilisers, radical scavengers, bleaches, bleach activators, soil suspenders, anti dusting agents, dispersants, pigments, silicones, perfumes and/or dyes.

Surfactants

The compositions herein may comprise a nonionic, anionic, zwitterionic and amphoteric surfactant or mixtures thereof. Said surfactant is preferably present at a level of from 0.01% to 20% of composition herein. Suitable surfactants are those selected from the group consisting of nonionic, anionic, zwitterionic and amphoteric surfactants, having hydrophobic chains containing from 8 to 18 carbon atoms. Examples of suitable surfactants are described in McCutcheon's Vol. 1: Emulsifiers and Detergents, North American Ed., McCutcheon Division, MC Publishing Co., 2002.

Preferably, the aqueous compositions comprise from 0.01% to 20%, more preferably from 0.5% to 10%, and most preferably from 1% to 5% surfactants.

Non-ionic surfactants are highly preferred for use in the compositions of the present invention. Non-limiting examples of suitable non-ionic surfactants include alcohol alkoxylates, alkyl polysaccharides, amine oxides, block copolymers of ethylene oxide and propylene oxide, fluoro surfactants and silicon based surfactants. Preferably, the aqueous compositions comprise from 0.01% to 20%, more preferably from 0.5% to 10%, and most preferably from 1% to 5% non-ionic surfactants.

A preferred class of non-ionic surfactants suitable for the present invention is alkyl ethoxylates. The alkyl ethoxylates of the present invention are either linear or branched, and contain from 8 carbon atoms to 16 carbon atoms in the hydrophobic tail, and from 3 ethylene oxide units to 25 ethylene oxide units in the hydrophilic head group. Examples of alkyl ethoxylates include Neodol 91-6®, Neodol 91-8® supplied by the Shell Corporation (P.O. Box 2463, 1 Shell Plaza, Houston, Tex.), and Alfonic 810-60® supplied by Condea Corporation, (900 Threadneedle P.O. Box 19029, Houston, Tex.). More preferred alkyl ethoxylates comprise from 9 to 12 carbon atoms in the hydrophobic tail, and from 4 to 9 oxide units in the hydrophilic head group. A most preferred alkyl ethoxylate is $C_{9-11}EO_5$, available from the Shell Chemical Company under the tradename Neodol 91-5®. Non-ionic ethoxylates can also be derived from branched alcohols. For example, alcohols can be made from branched olefin feedstocks such as propylene or butylene. In a preferred embodiment, the branched alcohol is either a 2-propyl-1-heptyl alcohol or 2-butyl-1-octyl alcohol. A desirable branched alcohol ethoxylate is 2-propyl-1-heptyl EO7/AO7, manufactured and sold by BASF Corporation under the tradename Lutensol XP 79/XL 79®. Another class of non-ionic surfactant suitable for the present invention is alkyl polysaccharides. Such surfactants are disclosed in U.S. Pat. Nos. 4,565,647, 5,776,872, 5,883,062, and 5,906,973. Among alkyl polysaccharides, alkyl polyglycosides comprising five and/or six carbon sugar rings are preferred, those comprising six carbon sugar rings are more preferred, and those wherein the six carbon sugar ring is derived from glucose, i.e., alkyl polyglucosides ("APG"), are most preferred. The alkyl substituent in the APG chain length is preferably a saturated or unsaturated alkyl moiety containing from 8 to 16 carbon atoms, with an average chain length of 10 carbon atoms. $C_8$-$C_{16}$ alkyl polyglucosides are commercially available from several suppliers (e.g., Simusol® surfactants from Seppic Corporation, 75 Quai d'Orsay, 75321 Paris, Cedex 7, France, and Glucopon 220®, Glucopon 225®, Glucopon 425®, Plantaren 2000 N®, and Plantaren 2000 N UP®, from Cognis Corporation, Postfach 13 01 64, D 40551, Dusseldorf, Germany).

Another class of non-ionic surfactant suitable for the present invention is amine oxide. Amine oxides, particularly those comprising from 10 carbon atoms to 16 carbon atoms in the hydrophobic tail, are beneficial because of their strong cleaning profile and effectiveness even at levels below 0.10%. Additionally $C_{10-16}$ amine oxides, especially $C_{12}$-$C_{14}$ amine oxides are excellent solubilizers of perfume. Alternative non-ionic detergent surfactants for use herein are alkoxylated alcohols generally comprising from 8 to 16 carbon atoms in the hydrophobic alkyl chain of the alcohol. Typical alkoxylation groups are propoxy groups or ethoxy groups in combination with propoxy groups, yielding alkyl ethoxy propoxylates. Such compounds are commercially available under the tradename Antarox® available from Rhodia (40 Rue de la Haie-Coq F-93306, Aubervilliers Cédex, France) and under the tradename Nonidet® available from Shell Chemical.

Also suitable for use in the present invention are the fluorinated nonionic surfactants. One particularly suitable fluorinated nonionic surfactant is Fluorad F170 (3M Corporation, 3M Center, St. Paul, Minn., USA). Fluorad F170 has the formula $C_8F_{17}SO_2N(CH_2—CH_3)(CH_2CH_2O)_x$. Also suitable for use in the present invention are silicon-based surfactants. One example of these types of surfactants is Silwet L7604 available from Dow Chemical (1691 N. Swede Road, Midland, Mich., USA).

The condensation products of ethylene oxide with a hydrophobic base formed by the condensation of propylene oxide with propylene glycol are also suitable for use herein. The hydrophobic portion of these compounds will preferably have a molecular weight of from 1500 to 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to 40 moles of ethylene oxide. Examples of compounds of this type include certain of the commercially available Pluronic® surfactants, marketed by BASF. Chemically, such surfactants have the structure $(EO)_x(PO)_y(EO)_z$ or $(PO)_x(EO)_y(PO)_z$ wherein x, y, and z are from 1 to 100, preferably 3 to 50. Pluronic® surfactants known to be good wetting surfactants are more preferred. A description of the Pluronic® surfactants, and properties thereof, including wetting properties, can be found in the brochure entitled "BASF Performance Chemicals Plutonic® & Tetronic® Surfactants", available from BASF.

Other suitable though not preferred non-ionic surfactants include the polyethylene oxide condensates of alkyl phenols, e.g., the condensation products of alkyl phenols having an alkyl group containing from 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds can be derived from oligomerized propylene, diisobutylene, or from other sources of iso-octane n-octane, iso-nonane or n-nonane. Other nonionic surfactants that can be used include those derived from natural sources such as sugars and include $C_8$-$C_{16}$ N-alkyl glucose amide surfactants.

Suitable anionic surfactants for use herein are all those commonly known by those skilled in the art. Preferably, the anionic surfactants for use herein include alkyl sulphonates, alkyl aryl sulphonates, alkyl sulphates, alkyl alkoxylated sulphates, $C^6$-$C^{20}$ alkyl alkoxylated linear or branched diphenyl oxide disulphonates, or mixtures thereof.

Suitable alkyl sulphonates for use herein include water-soluble salts or acids of the formula $RSO^3M$ wherein R is a $C^6$-$C^{20}$ linear or branched, saturated or unsaturated alkyl group, preferably a $C^8$-$C^{18}$ alkyl group and more preferably a $C^{10}$-$C^{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$-$C_{20}$ linear or branched saturated or unsaturated alkyl group, preferably a $C_8$-$C_{18}$ alkyl group and more preferably a $C_{10}$-$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

An example of a $C_{14}$-$C_{16}$ alkyl sulphonate is Hostapur® SAS available from Hoechst. An example of commercially available alkyl aryl sulphonate is Lauryl aryl sulphonate from Su.Ma. Particularly preferred alkyl aryl sulphonates are alkyl benzene sulphonates commercially available under trade name Nansa® available from Albright&Wilson.

Suitable alkyl sulphate surfactants for use herein are according to the formula $R_1SO_4M$ wherein $R_1$ represents a hydrocarbon group selected from the group consisting of straight or branched alkyl radicals containing from 6 to 20 carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Particularly preferred branched alkyl sulphates to be used herein are those containing from 10 to 14 total carbon atoms like Isalchem 123 AS®. Isalchem 123 AS® commercially available from Enichem is a $C_{12-13}$ surfactant which is 94% branched. This material can be described as $CH_3$—$(CH_2)_m$—$CH(CH_2OSO_3Na)$—$(CH_2)_n$—$CH_3$ where n+m=8-9. Also preferred alkyl sulphates are the alkyl sulphates where the alkyl chain comprises a total of 12 carbon atoms, i.e., sodium 2-butyl octyl sulphate. Such alkyl sulphate is commercially available from Condea under the trade name Isofol® 12S. Particularly suitable liner alkyl sulphonates include $C_{12}$-$C_{16}$ paraffin sulphonate like Hostapur® SAS commercially available from Hoechst.

Suitable alkyl alkoxylated sulphate surfactants for use herein are according to the formula $RO(A)_mSO_3M$ wherein R is an unsubstituted $C_6$-$C_{20}$ alkyl or hydroxyalkyl group having a $C_6$-$C_{20}$ alkyl component, preferably a $C_{12}$-$C_{20}$ alkyl or hydroxyalkyl, more preferably $C_{12}$-$C_{18}$ alkyl or hydroxyalkyl, A is an ethoxy or propoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$-$C_{18}$ alkyl polyethoxylate (1.0) sulfate ($C_{12}$-$C_{18}$E(1.0)SM), $C_{12}$-$C_{18}$ alkyl polyethoxylate (2.25) sulfate ($C_{12}$-$C_{18}$E(2.25)SM), $C_{12}$-$C_{18}$ alkyl polyethoxylate (3.0) sulfate ($C_{12}$-$C_{18}$E(3.0)SM), and $C_{12}$-$C_{18}$ alkyl polyethoxylate (4.0) sulfate ($C_{12}$-$C_{18}$E(4.0)SM), wherein M is conveniently selected from sodium and potassium.

Suitable $C_6$-$C_{20}$ alkyl alkoxylated linear or branched diphenyl oxide disulphonate surfactants for use herein are according to the following formula:

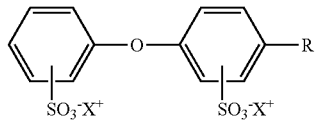

wherein R is a $C_6$-$C_{20}$ linear or branched, saturated or unsaturated alkyl group, preferably a $C_{12}$-$C_{18}$ alkyl group and more preferably a $C_{14}$-$C_{16}$ alkyl group, and X+ is H or a cation, e.g., an alkali metal cation (e.g., sodium, potassium, lithium, calcium, magnesium and the like). Particularly suitable $C_6$-$C_{20}$ alkyl alkoxylated linear or branched diphenyl oxide disulphonate surfactants to be used herein are the C12 branched di phenyl oxide disulphonic acid and C16 linear di phenyl oxide disulphonate sodium salt respectively commercially available by DOW under the trade name Dowfax 2A1® and Dowfax 8390®.

Other anionic surfactants useful herein include salts (including, for example, sodium, potassium, ammonium, and substituted ammonium salts such as mono-, di- and triethanolamine salts) of soap, $C_8$-$C_{24}$ olefinsulfonates, sulphonated polycarboxylic acids prepared by sulphonation of the pyrolyzed product of alkaline earth metal citrates, e.g., as described in British patent specification No. 1,082,179, $C_8$-$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside (the nonionic nonsulfated compounds being described below), alkyl polyethoxy carboxylates such as those of the formula $RO(CH_2CH_2O)_kCH_2COO\text{-}M^+$ wherein R is a $C_8$-$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Zwitterionic surfactants represent another class of preferred surfactants within the context of the present invention.

Zwitterionic surfactants contain both cationic and anionic groups on the same molecule over a wide pH range. The typical cationic group is a quaternary ammonium group, although other positively charged groups like sulfonium and phosphonium groups can also be used. The typical anionic groups are carboxylates and sulfonates, preferably sulfonates, although other groups like sulfates, phosphates and the like, can be used. Some common examples of these detergents are described in the patent literature: U.S. Pat. Nos. 2,082,275, 2,702,279 and 2,255,082.

A specific example of a zwitterionic surfactant is 3-(N-dodecyl-N,N-dimethyl)-2-hydroxypropane-1-sulfonate (Lauryl hydroxyl sultaine) available from the McIntyre Company (24601 Governors Highway, University Park, Ill. 60466, USA) under the tradename Mackam LHS®. Another specific zwitterionic surfactant is $C_{12\text{-}14}$ acylamidopropylene(hydroxypropylene)sulfobetaine that is available from McIntyre under the tradename Mackam 50-SB®. Other very useful zwitterionic surfactants include hydrocarbyl, e.g., fatty alkylene betaines. A highly preferred zwitterionic surfactant is Empigen BB®, a coco dimethyl betaine produced by Albright & Wilson. Another equally preferred zwitterionic surfactant is Mackam 35HP®, a coco amido propyl betaine produced by McIntyre.

Another class of preferred surfactants comprises the group consisting of amphoteric surfactants. One suitable amphoteric surfactant is a $C_8$-$C_{16}$ amido alkylene glycinate surfactant ('ampho glycinate'). Another suitable amphoteric surfactant is a $C_8$-$C_{16}$ amido alkylene propionate surfactant ('ampho propionate'). Other suitable, amphoteric surfactants are represented by surfactants such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol®", and described in U.S. Pat. No. 2,528,378.

The weight ratio of water-soluble or water-dispersible copolymer herein to nonionic, anionic, amphoteric, zwitterionic surfactant or mixtures thereof is between 1:100 and 10:1, more preferably between 1:50 and 1:1.

Water-Soluble or Water-Dispersible Copolymer

The compositions of the present invention may comprise water-soluble or water-dispersible copolymer.

The water-soluble or water-dispersible copolymer can be either a water-soluble or water-dispersible copolymer I as described below or a water-soluble or water-dispersible copolymer II as described herein below.

The water-soluble or water-dispersible copolymer I of the present invention comprises, in the form of polymerized units:

a) at least a monomer compound of general formula i:

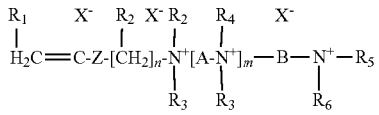

(i)

in which $R_1$ is a hydrogen atom, a methyl or ethyl group;

$R_2$, $R_3$, $R_4$, $R_5$ and $R_6$, which are identical or different, are linear or branched $C_1$-$C_6$, alkyl, hydroxyalkyl or aminoalkyl groups;

m is an integer from 0 to 10;

n is an integer from 1 to 6;

Z represents a —C(O)O— or —C(O)NH— group or an oxygen atom;

A represents a $(CH_2)_p$ group, p being an integer from 1 to 6;

B represents a linear or branched $C_2$-$C_{12}$, polymethylene chain optionally interrupted by one or more heteroatoms or heterogroups, and optionally substituted by one or more hydroxyl or amino groups;

$X^-$, which are identical or different, represent counterions; and (b) at least one hydrophilic monomer carrying a functional acidic group which is copolymerizable with (a) and which is capable of being ionized in the application medium;

(c) optionally at least one monomer compound with ethylenic unsaturation with a neutral charge which is copolymerizable with (a) and (b), preferably a hydrophilic monomer compound with ethylenic unsaturation with a neutral charge, carrying one or more hydrophilic groups, which is copolymerizable with (a) and (b).

The monomer (a) can be prepared, for example, according to the reaction schemes shown in U.S. Pat. No. 6,569,261 to Rhodia, column 2, line 40 to column 3, line 45 which is incorporated herein by reference.

Preferably, in the general formula (i) of the monomer (a), Z represents C(O)O, C(O)NH or O, very preferably C(O)NH; n is equal to 2 or 3, very particularly 3; m ranges from 0 to 2 and is preferably equal to 0 or 1, very particularly to 0; B represents —CH2-CH(OH)—(CH2)q, with q from 1 to 4, preferably equal to 1; $R_1$ to $R_6$, which are identical or different, represent a methyl or ethyl group.

The water-soluble or water-dispersible copolymer II of the present invention comprises, in the form of polymerized units:

d) at least a monomer compound of general formula ii:

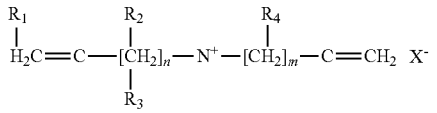

(ii)

in which:

R1 and R4 independently represent H or a C1-6 linear or branched alkyl group;

R2 and R3 independently represent a linear or branched C1-6 alkyl, hydroxyalkyl or aminoalkyl group, preferably a methyl group;

n and m are integers of between 1 and 3;

$X^-$ represents a counterion compatible with the water-soluble or water-dispersible nature of the polymer;

e) at least one hydrophilic monomer with an acid functionality that is copolymerisable with monomer d) and capable of ionizing in the medium in which it is used; and f) optionally an ethylenically unsaturated hydrophilic monomer compound of neutral charge bearing one or several hydrophilic groups which is copolymerisable with monomers d) and e); the monomer d) to monomer e) ratio ranging from between 60:40 and 5:95.

More preferably, $R_1$ represents hydrogen, $R_2$ represents methyl, $R_3$ represents methyl, $R_4$ represents hydrogen, and m and n are equal to 1. The ion $X^-$ is preferably chosen from halogen, sulfate, hydrogen sulfate, phosphate, citrate, formate and acetate.

Suitable Water-Soluble or Water-dispersible Copolymer which can be used herein are more described in European patent application 06 112 673.61.

Chelating Agents

One class of optional compounds for use herein includes chelating agents or mixtures thereof. Chelating agents can be incorporated in the compositions herein in amounts ranging from 0.0% to 10.0% by weight of the total composition, preferably 0.01% to 5.0%.

Suitable phosphonate chelating agents for use herein may include alkali metal ethane 1-hydroxy diphosphonates (HEDP), alkylene poly(alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®. Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene. A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates for use herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents for use herein include salicylic acid, aspartic acid, glutamic acid, glycine, malonic acid or mixtures thereof.

Fatty Acid

The liquid compositions of the present invention may comprise a fatty acid, or mixtures thereof as an optional ingredient.

Suitable fatty acids for use herein are the alkali salts of a $C_8$-$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22, preferably from 8 to 20 and more preferably from 8 to 18 carbon atoms.

Suitable fatty acids may be selected from caprylic acid, capric acid, lauric acid, myristic acid, palmitic acid, stearic acid, oleic acid, and mixtures of fatty acids suitably hardened, derived from natural sources such as plant or animal esters (e.g., palm oil, olive oil, coconut oil, soybean oil, castor oil, tallow, ground oil, whale and fish oils and/or babassu oil.

For example Coconut Fatty Acid is commercially available from UNICHEMA under the name PRIFAC 5900®.

Fatty acids are desired herein as they reduce the sudsing of the liquid composition used in the process according to the present invention.

Typically, the liquid composition herein may comprise up to 6%, preferably from 0.1% to 2.0%, more preferably from 0.1% to 1.0% and most preferably from 0.2% to 0.8% by weight of the total composition of said fatty acid.

Branched Fatty Alcohol

The liquid compositions of the present invention may comprise a branched fatty alcohol, or mixtures thereof as a highly preferred optional ingredient.

Such suitable compounds are commercially available, for instance, as the Isofol® series such as Isofol® 12 (2-butyl octanol) or Isofol® 16 (2-hexyl decanol) commercially available from Condea.

Preferably said branched fatty alcohol is selected from the group consisting of 2-butyl octanol, 2-hexyl decanol, and a mixture thereof. More preferably said 2-alkyl alkanol is 2-butyl octanol. Typically, the liquid composition herein may comprise up to 2%, preferably from 0.10% to 1.0%, more preferably from 0.1% to 0.8% and most preferably from 0.1% to 0.5% by weight of the total composition of said branched fatty alcohol.

Solvent

The liquid compositions of the present invention may comprise a solvent, or mixtures thereof as an optional ingredient.

Suitable solvent is selected from the group consisting of: ethers and diethers having from 4 to 14 carbon atoms, preferably from 6 to 12 carbon atoms, and more preferably from 8 to 10 carbon atoms; glycols or alkoxylated glycols; alkoxylated aromatic alcohols; aromatic alcohols; alkoxylated aliphatic alcohols; aliphatic alcohols; $C_8$-$C_{14}$ alkyl and cycloalkyl hydrocarbons and halohydrocarbons; $C_6$-$C_{16}$ glycol ethers; terpenes; and mixtures thereof.

Suitable glycols to be used herein are according to the formula HO—$CR_1R_2$—OH wherein $R_1$ and $R_2$ are independently H or a $C_2$-$C_{10}$ saturated or unsaturated aliphatic hydrocarbon chain and/or cyclic. Suitable glycols to be used herein are dodecaneglycol and/or propanediol.

Suitable alkoxylated glycols to be used herein are according to the formula R-$(A)_n$-$R_1$—OH wherein R is H, OH, a linear or branched, saturated or unsaturated alkyl of from 1 to 20 carbon atoms, preferably from 2 to 15 and more preferably from 2 to 10, wherein $R_1$ is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable alkoxylated aromatic alcohols to be used herein are according to the formula R-$(A)_n$-OH wherein R is an alkyl substituted or non-alkyl substituted aryl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Suitable alkoxylated aromatic alcohols are benzoxyethanol and/or benzoxypropanol.

Suitable aromatic alcohols to be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable alkoxylated aliphatic alcohols to be used herein are according to the formula R-$(A)_n$-OH wherein R is a linear or branched, saturated or unsaturated alkyl group of from 1 to 20 carbon atoms, preferably from 2 to 15 and more preferably from 3 to 12, wherein A is an alkoxy group preferably butoxy, propoxy and/or ethoxy, and n is an integer of from 1 to 5, preferably 1 to 2. Suitable alkoxylated aliphatic linear or branched alcohols are butoxy propoxy propanol (n-BPP), butoxyethanol, butoxypropanol (n-BP), ethoxyethanol, 1-methylpropoxyethanol, 2-methylbutoxyethanol, or mixtures thereof. Butoxy propoxy propanol is commercially available under the trade name n-BPP® from Dow chemical. Butoxypropanol is commercially available from Dow chemical.

Suitable aliphatic alcohols to be used herein are according to the formula R—OH wherein R is a linear or branched, saturated or unsaturated alkyl group of from 1 to 20 carbon atoms, preferably from 2 to 15 and more preferably from 5 to 12. With the proviso that said aliphatic branched alcohols is not a 2-alkyl alkanol as described herein above. Suitable aliphatic alcohols are methanol, ethanol, propanol, isopropanol or mixtures thereof.

Suitable terpenes to be used herein monocyclic terpenes, dicyclic terpenes and/or acyclic terpenes. Suitable terpenes are: D-limonene; pinene; pine oil; terpinene; terpene derivatives as menthol, terpineol, geraniol, thymol; and the citronella or citronellol types of ingredients.

Other suitable solvents include butyl diglycol ether (BDGE), hexandiols, butyltriglycol ether, ter amilic alcohol and the like. BDGE is commercially available from Union Carbide or from BASF under the trade name Butyl CARBITOL®.

Preferably said solvent is selected from the group consisting of butoxy propoxy propanol, butyl diglycol ether, benzyl alcohol, butoxypropanol, ethanol, methanol, isopropanol, hexandiols and mixtures thereof. More preferably said solvent is selected from the group consisting of butoxy propoxy propanol, butyl diglycol ether, benzyl alcohol, butoxypropanol, ethanol, methanol, isopropanol and mixtures thereof. Even more preferably said solvent is selected from the group consisting of butyl diglycol ether, butoxypropanol, ethanol and mixtures thereof.

Typically, the liquid composition herein may comprise up to 30%, preferably from 1% to 25%, more preferably from 1% to 20% and most preferably from 2% to 10% by weight of the total composition of said solvent or mixture thereof.

In a preferred embodiment the solvent comprised in the liquid composition according to the present invention is a volatile solvent or a mixture thereof, preferably a volatile solvent or a mixture thereof in combination with another solvent or a mixture thereof.

Perfumes

The liquid compositions of the present invention may comprise a perfume or a mixture thereof as a highly preferred optional ingredient.

Suitable perfumes for use herein include materials which provide an olfactory aesthetic benefit and/or cover any "chemical" odor that the product may have.

The compositions herein may comprise a perfume or a mixture thereof, in amounts up to 5.0%, preferably in amounts of 0.01% to 2.0%, more preferably in amounts of 0.05% to 1.5%, even more preferably in amounts of 0.1% to 1.0%, by weight of the total composition.

Builders

The liquid compositions of the present invention may also comprise a builder or a mixture thereof, as an optional ingredient.

Suitable builders for use herein include polycarboxylates and polyphosphates, and salts thereof. Typically, the compositions of the present invention comprise up to 20.0% by weight of the total composition of a builder or mixtures thereof, preferably from 0.1% to 10.0%, and more preferably from 0.5% to 5.0%.

Radical Scavenger

The compositions of the present invention may comprise a radical scavenger. Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl)butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®.

Radical scavengers when used, are typically present herein in amounts up to 10% and preferably from 0.001% to 0.5% by weight of the total composition.

The presence of radical scavengers may contribute to the chemical stability of the compositions of the present invention.

Other Adjuvants

Non-limiting examples of other adjuncts are: hydrotropes such as sodium toluene sulfonate, sodium cumene sulfonate and potassium xylene sulfonate, and aesthetic-enhancing ingredients such as colorants, providing they do not adversely impact on filming/streaking. The compositions can also comprise one or more colored dyes or pigments. Dyes, pigments and disappearing dyes, if present, will constitute from 0.1 ppm to 50 ppm by weight of the aqueous composition.

Example 1

Compositions

The compositions are made by combining the listed ingredients in the listed proportions (weight % unless otherwise specified).

| | | A | B | C | D | E | F | G |
|---|---|---|---|---|---|---|---|---|
| Nonionic surfactants: | C9-11 EO5 | 4.5 | — | 9.0 | 4.0 | 3.0 | — | — |
| | C12,14 EO5 | 1.5 | — | — | 6.0 | 0.5 | 0.7 | — |
| | C10 AO7 | — | 3.5 | — | — | — | — | 3.0 |
| | C12-14 EO21 | — | — | — | 2.0 | — | — | — |
| Anionic surfactants: | NaLAS | 0.5 | 0.2 | 0.4 | 1.5 | 0.2 | — | 0.5 |
| | Isalchem ® AS | — | — | — | — | — | 0.4 | — |
| | NaCS | 1.5 | 0.7 | 1.7 | 3.0 | 1.4 | 0.8 | 0.8 |
| Co-surfactants | C12-14 AO | 0.2 | — | — | — | 0.1 | 0.5 | — |
| Polytrisiloxane ingredient α | | 0.2 | 0.5 | 0.3 | 0.4 | 0.25 | 0.5 | 0.4 |
| Copolymer I | | 0.1 | — | — | 0.15 | — | 0.075 | — |
| Copolymer II | | — | 0.1 | 0.15 | — | 0.05 | — | 0.1 |
| Chelants | DTPMP | 0.1 | 0.1 | 0.2 | — | 0.15 | — | 0.1 |
| Buffer: | $Na_2CO_3$ | 0.2 | 0.4 | 1.0 | 1.0 | 0.6 | — | 0.5 |
| | Citric acid | 1.0 | — | 0.8 | 0.7 | 0.5 | 1.0 | — |
| | Caustic | 0.8 | — | 0.3 | 0.4 | 0.3 | 0.7 | — |
| Suds control | Fatty Acid | 0.8 | 0.3 | 0.3 | 0.2 | 0.2 | 0.3 | 0.2 |
| | Isofol 12 ® | — | — | — | 0.5 | — | — | — |
| Solvents | EtOH | — | — | — | — | — | — | 1.0 |
| | n-BP | — | — | — | — | — | 5.5 | 3.0 |
| | MEA | — | — | — | — | — | 0.7 | — |
| Minors and water | | | | | Up to 100% | | | |
| pH | | 9.5 | 9.5 | 9.5 | 9.5 | 10.0 | 11.0 | 9.5 |

Copolymer I derived from Diquat and acrylic acid molar ratio 33/67.

Copolymer II derived from DADMAC and acrylic acid, molar ratio 40/60.

C9-11 EO5 is a C 9-11 EO5 nonionic surfactant commercially available from Shell.

C12,14 EO5 is a C12, 14 EO5 nonionic surfactant commercially available from Hoechst.

C10 AO7 is an alkoxylated non-ionic surfactant commercially available from BASF under the tradename Lutensol XL7 ®

C12,14 EO21 is a C12-14 EO21 nonionic surfactant commercially available from BASF.

NaLAS is Sodium Linear Alkylbenzene sulphonate commercially available from A&W.

NaCS is Sodium Cumene sulphonate commercially available from A&W.

Isalchem ® AS is a $C_{12-13}$ sulphate surfactant commercially available from Enichem.

C12-14 AO is a C12-14 amine oxide surfactant commercially available from ICI.

DTPMP is diethylenetriaminepentamethylphosponic acid commercially available from Solutia.

Isofol 12 ® is 2-butyl octanol commercially available from Condea.

n-BP is normal butoxy propanol commercially available from Dow Chemicals.

Ethanol is commercially available from Condea.

MEA is mono-ethanolamine commercially available from Condea.

Polytrisiloxane ingredient α is a silicone polymer name Silwet ® L7280 available from Momentive. having the formula $(CH_3)_3Si—O(CH_3)Si([CH_2]_3—O—[CH_2CH_2O]_4[CH_2CH_2CH_2O]_2CH_3)O—Si(CH_3)_3$.

Example of compositions A to G are packed in dispersing containers, adapted to discharge said liquid composition under a "fan-shaped" spray, and sprinkled onto horizontal hard surfaces.

Example 2

Performance Test

All the tests are conducted in the VHTR (Variable Humidity and Temperature Room) set at 20° C. and 40% rH.

1. Shining Tests

The solutions for this test are made of 1.2 w/w % diluted test product with water. This test is done on black glossy ceramic tiles. The initial gloss is measured with a gloss meter.

To measure shine besides gloss, visual grading is used. The grading of the shine is always assessed versus a REFERENCE product (with a known result for the specific condition). The results of this procedure are evaluated by using the relative PSU (Panel Score Units) scale. (0 to 4, wherein 0=no difference and 4=very large difference between reference and test product), recalculated afterwards into a shine index. In this table, the shine indices for the test products are given with the significance. The reference has always a shine index of 100.

The impact of addition of Polytrisiloxane ingredient α (Silwet L7280) to a liquid formulation without this ingredient is assessed. The products are diluted (1.2%) with water. The reference is thus a composition without the Polytrisiloxane ingredient.

| | REFERENCE (without Polytrisiloxane) | +Polytrisiloxane ingredient α |
|---|---|---|
| N | 6 | 6 |
| Mean | 5.0 | 6.6 |
| StDev (n − 1) | 0.00 | 1.02 |
| Significance@ 95% | — | Significant |
| Shine Index | 100 | 132 |

The composition containing the trisiloxane ingredient shows an improvement shining effect by comparison with the composition not containing it.

2. Spreading and Drying Test

These tests were both made on ceramics (hydrophilic hard surface) and on PVC (hydrophobic hard surface). The spreading test is operated by dropping 200 μl of diluted (1.2%) composition containing increasing concentration of trisiloxane ingredient α (Silwet L7280) or without the trisiloxane ingredient, with an automatic pipette, on a preconditioned surface. The surface covered by the composition is then measured.

The drying test is operated by dropping 10 μl of the test solutions (containing or not the trisiloxane ingredient) on a clean tile. The time until the solution is completely dry is measured, as well as the covered surface area.

Figure 2:
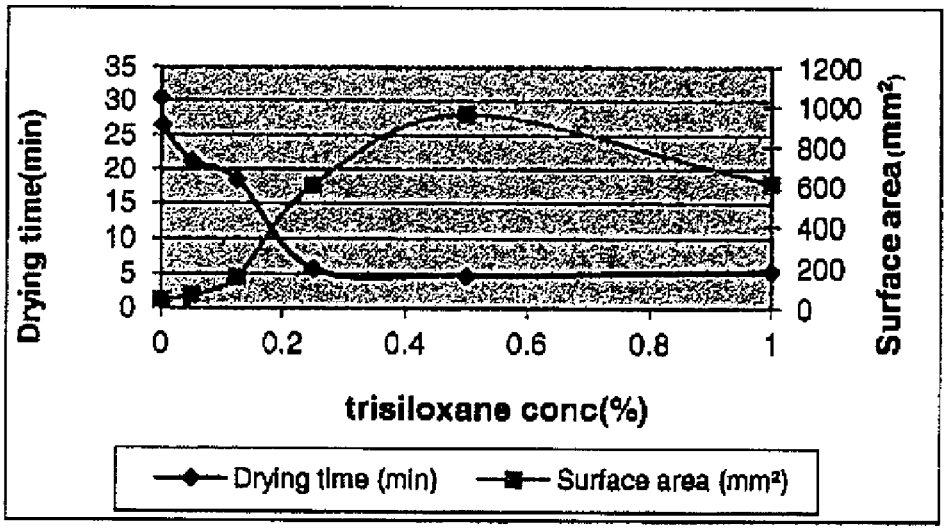
FIG. 2 illustrates the drying and spreading results obtained on PVC with compositions containing trisiloxane.

The results obtained, on Ceramic and on PVC, are shown in FIGS. 1 and 2.

FIGS. 1 and 2 show that excellent drying and spreading benefits are observed when compositions contain trisiloxane.

This effect is observed both when the composition is used on Ceramic or on PVC. The higher the surface area, the lower the drying time.

However, the addition of trisiloxanes gives a better spreading effect when use upon PVC. When used on PVC, the concentration of 0.5% of trisiloxane ingredient a delivers its maximum performance: up to 6 times faster drying speed and nearly 25 times higher surface area is observed by comparison with composition which do not contain trisiloxane ingredients.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process of treating a horizontal hard surface comprising:

applying a liquid composition onto said hard surface using a dispersing container, wherein said liquid composition comprises:

0.1 to 0.5% by weight polyalkoxylate trisiloxane having the formula (II):

$$(CH_3)_3Si—O—(CH_3)Si(R^4)O—Si(CH_3)_3 \quad (II)$$

wherein $R^4$=—$(CH_2)_x$—O—$(CH_2CH_2O)_y(CHCH_3CH_2O)_zR^5$; wherein x is 1 to 10, wherein y is 1 to 16, and wherein z is 1 to 12 and where $R^5$ is H or $CH_3$;

about 0.1 to about 20.0% by weight additional surfactant;

at least about 50% water; and fatty acids.

2. The process of claim 1 wherein $R^4$=—$(CH_2)_x$—O—$(CH_2CH_2O)_y(CHCH_3CH_2O)_z$ H: wherein x=3, wherein y=4 and wherein z=2.

3. The process of claim 1 wherein the liquid composition comprises from about 0.1 to about 1.0% by weight fatty acid.

4. The process of claim 1 wherein the surfactant comprises anionic surfactants, nonionic surfactants, or both.

5. The process of claim 4 wherein the surfactant of the liquid composition further comprises a zwiterrionic surfactant, a amphoteric surfactant, or a mixture thereof.

6. The process of claim 1 wherein the liquid composition comprises from about 1% to about 5% by weight surfactant.

7. The process of treating according to claim 1 wherein the trisiloxane has the formula (II) and wherein x=3, wherein y=4 and wherein z=2; and $R^5$ is H.

8. The process according to claim 1 wherein said dispersing container is adapted to discharge said liquid composition with a fan-shaped spray.

9. The process according to claim 1 wherein the liquid composition has a pH below 4 or above 9.

10. The process according to claim 1 wherein the liquid composition further comprises one or more ingredient selected from the group consisting of builders, chelants, polymers, buffers, bactericides, preservatives, hydrotropes, stabilizers, radical scavengers, bleaches, bleach activators, soil suspenders, anti dusting agents, dispersants, pigments, silicones, perfumes, dyes and a mixture thereof.

11. The process according to claim 1 which further comprises the steps of leaving said composition on said hard-surface to act and, optionally wiping said hard-surface, to remove the composition.

* * * * *